United States Patent [19]

Madray

[11] Patent Number: 4,569,169

[45] Date of Patent: Feb. 11, 1986

[54] LEVELING DEVICE

[76] Inventor: Herbert R. Madray, 4224 Highway 441 South, Okeechobee, Fla. 33472

[21] Appl. No.: 723,282

[22] Filed: Apr. 15, 1985

Related U.S. Application Data

[63] Continuation-in-part of PCT Ser. No. US84/00782, May 22, 1984 which is a continuation-in-part of Ser. No. 496,960, May 23, 1983

[51] Int. Cl.[4] ..... E04B 2/76

[52] U.S. Cl. ..... 52/126.1; 52/90; 52/126.3

[58] Field of Search ..... 52/122, 126.1, 126.3, 52/293, 299, 720, 721, 726, 741, 749, 272, 274, 281–283, 90–93

[56] References Cited

U.S. PATENT DOCUMENTS

| | | | |
|---|---|---|---|
| 1,570,226 | 1/1926 | Bosco | 52/126.1 X |
| 2,248,715 | 7/1941 | Mafera | 52/126.1 X |
| 2,574,074 | 11/1951 | Vogel | 52/377 |
| 2,795,305 | 6/1957 | Bagge | 52/126.3 X |
| 2,943,716 | 7/1960 | Babcock | 52/126.1 X |
| 4,135,335 | 1/1979 | Jensen | 52/126.1 |
| 4,438,607 | 3/1984 | Nelson | 52/126.1 |
| 4,439,961 | 4/1984 | Witte | 52/126.1 |

FOREIGN PATENT DOCUMENTS

| | | | |
|---|---|---|---|
| 985471 | 3/1976 | Canada | 52/126.1 |
| 2261534 | 12/1973 | Fed. Rep. of Germany | 52/122 |
| 1514263 | 1/1968 | France | 52/126.3 |

*Primary Examiner*—J. Karl Bell

*Attorney, Agent, or Firm*—Steele, Gould & Fried

[57] ABSTRACT

An apparatus for leveling floors and the like has base structure with support structure affixed thereto and projecting upwardly therefrom. The support structure defines an open-sided, open-topped slot. Wedge structure is positionable in the slot throughout the length of the support structure and is adapted for attachment to the support structure in a plurality of vertical positions. The wedge structure forms an abutment surface for supporting, and raising, a structural member disposed in the slot. Connecting structure detachably connects the wedge structure and the structural member to the support structure. Independent and alternate attachment to and repositioning of the wedge structure and the structural member to the support structure effects vertical adjustment of the structural member. Structure is provided to pull the wedge structure through the slot.

12 Claims, 13 Drawing Figures

LEVELING DEVICE

CROSS-REFERENCE TO RELATED APPLICATIONS

This application is a continuation-in-part of my PCT application Ser. No. US84/00782, filed May 22, 1984, which is a continuation-in-part of my U.S. application Ser. No. 496,960, filed May 23, 1983, pending 8-8-85 the teachings of both of which are fully incorporated herein by reference.

BACKGROUND OF THE INVENTION

1. Field of the Invention

This invention relates generally to leveling devices for floors and the like, and more particularly to wedge-type leveling devices.

2. Description of the Prior Art

In the construction industry, it is often desirable, if not necessary, for a construction to be level. The home construction industry in particular requires a level construction both for the safety and for the comfort of the occupants. The leveling process usually involves a trial and error method where the structure is lifted while the height of the support means is increased or decreased. The structure is checked to determine if level, and the sequence is repeated until the structure is level. Such processes are both tedious and time consuming.

Witte's U.S. Pat. No. 4,439,961 discloses a leveling and locating device wherein horizontal movement of a tapered wedge device causes vertical movement of a force-bearing structure.

Jensen's U.S. Pat. No. 4,135,335 discloses a blocking-up wedge for leveling joists and the like wherein at least one wedge surface is provided with a relatively great friction profiled formation such that slipping and lateral shifting of the wedges is controlled or prevented.

Mieyal's U.S. Pat. No. 4,113,219 discloses an adjustable pedestal for elevated floors wherein a wedge is horizontally displaceable to elevate a carrier element of the assembly to the desired elevation. Self-locking means maintain the wedge and carrier elements in their select positions.

Gobel's U.S. Pat. No. 3,750,987 discloses a bearing for supporting roof components above roof ceilings. Support bodies of wedge-like configuration rests upon corresponding support surfaces of a base body. Each support body is movable upwardly on its support surface but is prevented from moving downwards in the opposite direction.

Jonell et al's U.S. Pat. No. 3,631,643 discloses pairs of rubber wedges which are adjustable to different thicknesses. The wedges are located between the slabs and beams of building structures and held in place by an adhesive such that slabs are held in coplanar relation irrespective of differences in the level of the beams and slabs.

Babcock's U.S. Pat. No. 2,943,716 discloses a building construction wherein supporting columns within the building may be easily relocated. The construction includes a pair of wedge shaped base plates which can be used to raise or lower the column.

Wilkin's U.S. Pat. No. 2,819,037 discloses a leveling device consisting of two wedge-like bodies which are moved relative to one another by an adjusting screw so as to raise or lower a structure.

Bosco's U.S. Pat. No. 1,570,226 discloses an adjustable shore with a channel member receiving a post at its top and bottom ends. Rough height adjustment is made by mounting the top post in the channel member on a pin at a depth selected such that the channel and post combination approximates the desired shore height. Fine height adjustment is accomplished by driving a pair of coacting wedges through a slot in the channel member and against the bottom post so as to raise the channel member relative to the bottom post.

SUMMARY OF THE INVENTION

It is an object of the present invention to provide a leveling device which is quickly and easily manipulated to level floors and the like.

It is another object of the present invention to provide a leveling device which is adjustable to very small increments of height.

It is yet another object of the invention to provide a leveling device which is positively maintained at the desired height.

It is still another object of the present invention to provide a leveling device which can easily be used to perform large height adjustment.

It is a further object of the present invention to provide a leveling device which can be inexpensively fashioned from construction materials.

These and other objects are accomplished by a leveling device with parallel support structure upwardly affixed to a base means. Additional structure may be included to provide firm and stable support for the leveling device. The support structure defines a vertical open-sided, open-topped slot therebetween extending substantially for the length of the support structure to receive a structural member and wedge structure. The wedge structure preferably includes a wedge stop, which is positively attached to the support structure, and a wedge which is driven between the wedge stop and the structural member to raise the structural member. The structural member and wedge structures can be positively, i.e., non-frictionally, attached to the support structures. The structural member preferably has a series of holes which align with holes in the support structure to receive screws and the like. The structural member thereby can be positively attached to the support structure at the proper height. The structural member is preferably formed with side flanges to prevent it from slipping sideways in the slot and misaligning during the leveling process.

In an alternative embodiment, the leveling device includes structure for pulling the wedge structure through the slot and thereby effecting raising of the structural member. This pulling structure preferably includes structure for engaging the wedge structure, structure for moving the wedge structure, and structure for driving the moving structure.

BRIEF DESCRIPTION OF THE DRAWINGS

There are shown in the drawings embodiments which are presently preferred. It should be understood, however, that the invention is not limited to the precise arrangements and instrumentalities shown.

DETAILED DESCRIPTION OF THE PREFERRED EMBODIMENTS

An apparatus for leveling floors and the like according to the present invention is shown in FIGS. 1-5. It will be appreciated that the invention can be used to establish precise, but inclined orientations as well. Parallel support members 10, 12 are upwardly affixed to a base means. The support members define a vertical open sided, open-topped, slot 14 extending substantially for the length of the support members. The slot 14 is adapted to receive a structural member and wedge members. Means are provided for positively attaching the wedge members to the support members, and for positively attaching the structural member to the support members in a variety of vertical positions.

Figure 1:
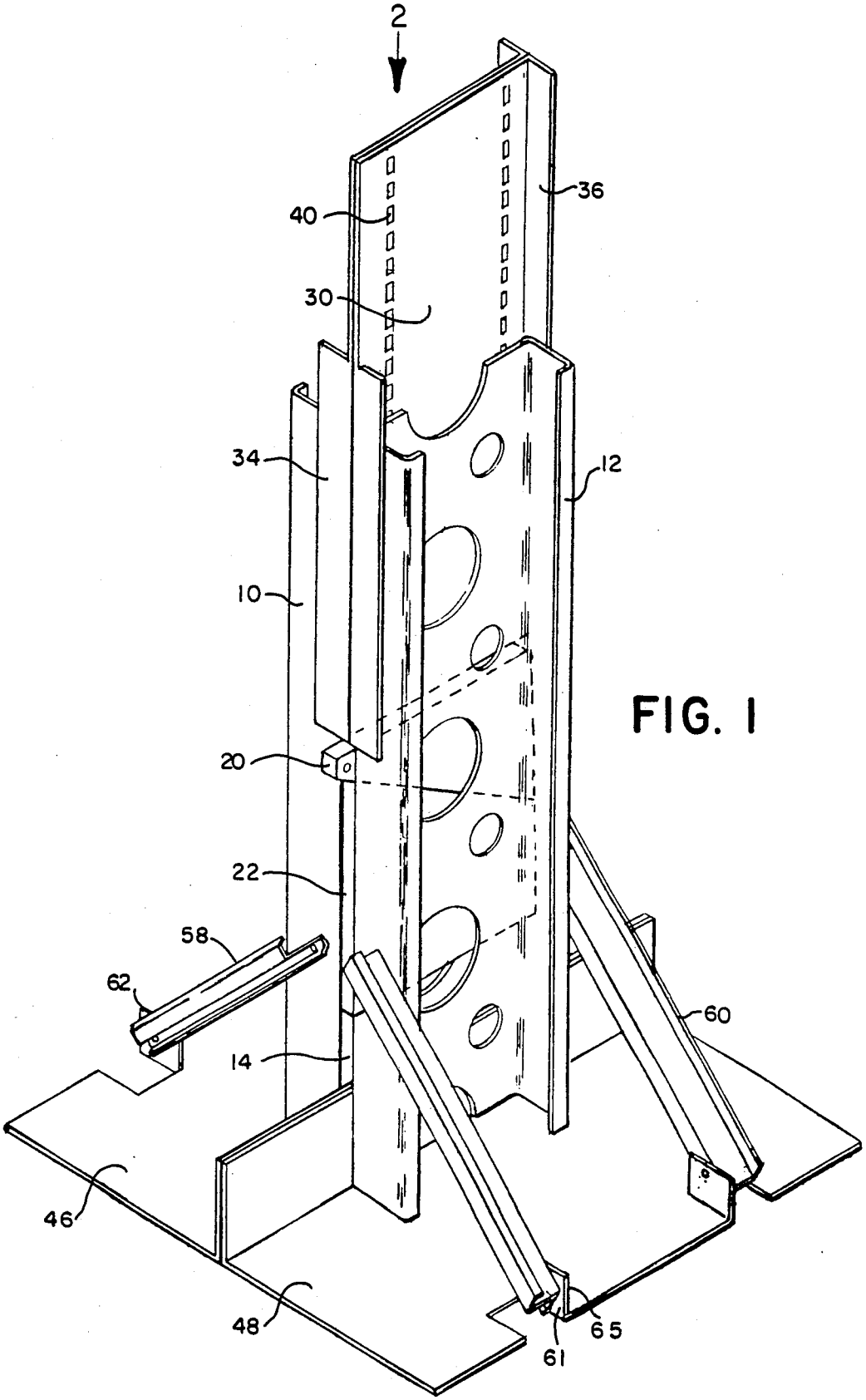
FIG. 1 is a perspective view of a leveling device according to the present invention.
Figure 2:
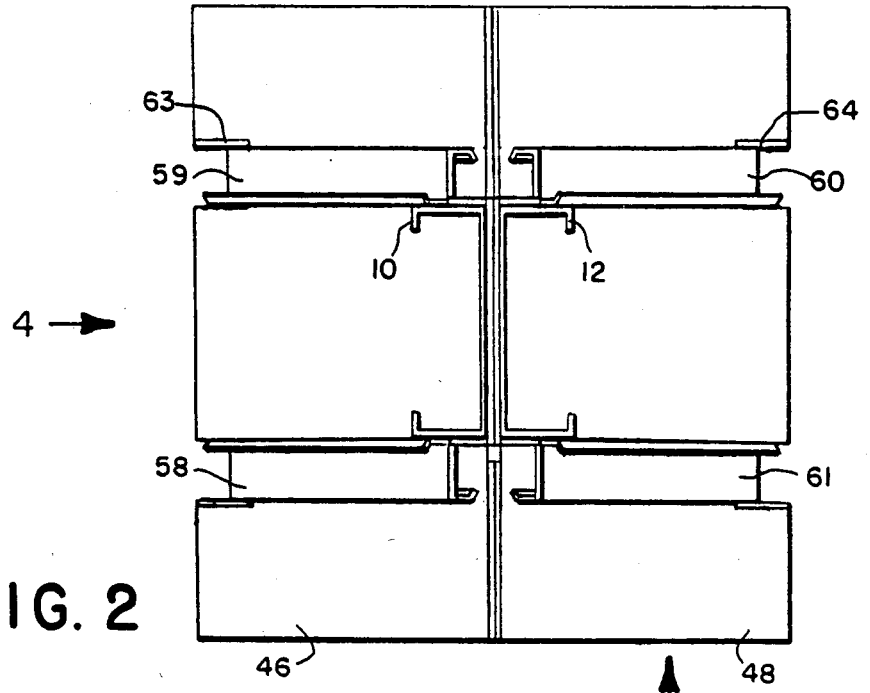
FIG. 2 is a plan view.
Figure 3:
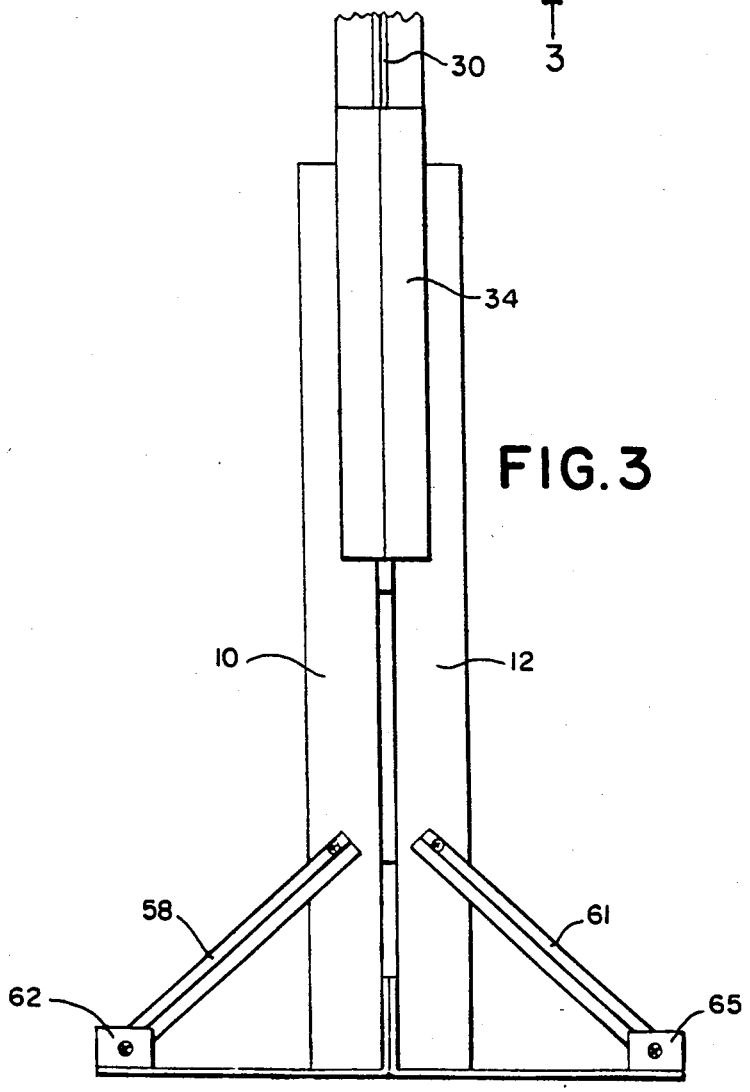
FIG. 3 is a side elevation as indicated by the arrow in FIG. 2.
Figure 4:
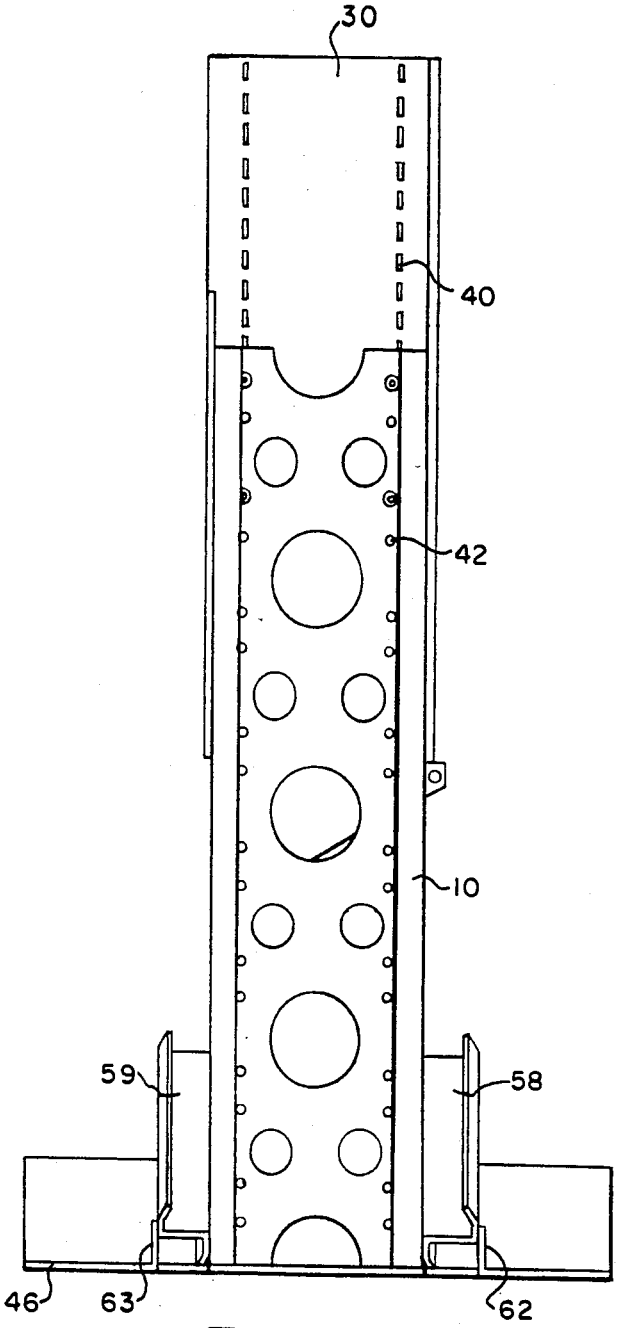
FIG. 4 is a side elevation as indicated by the arrow in FIG. 2.
Figure 5:
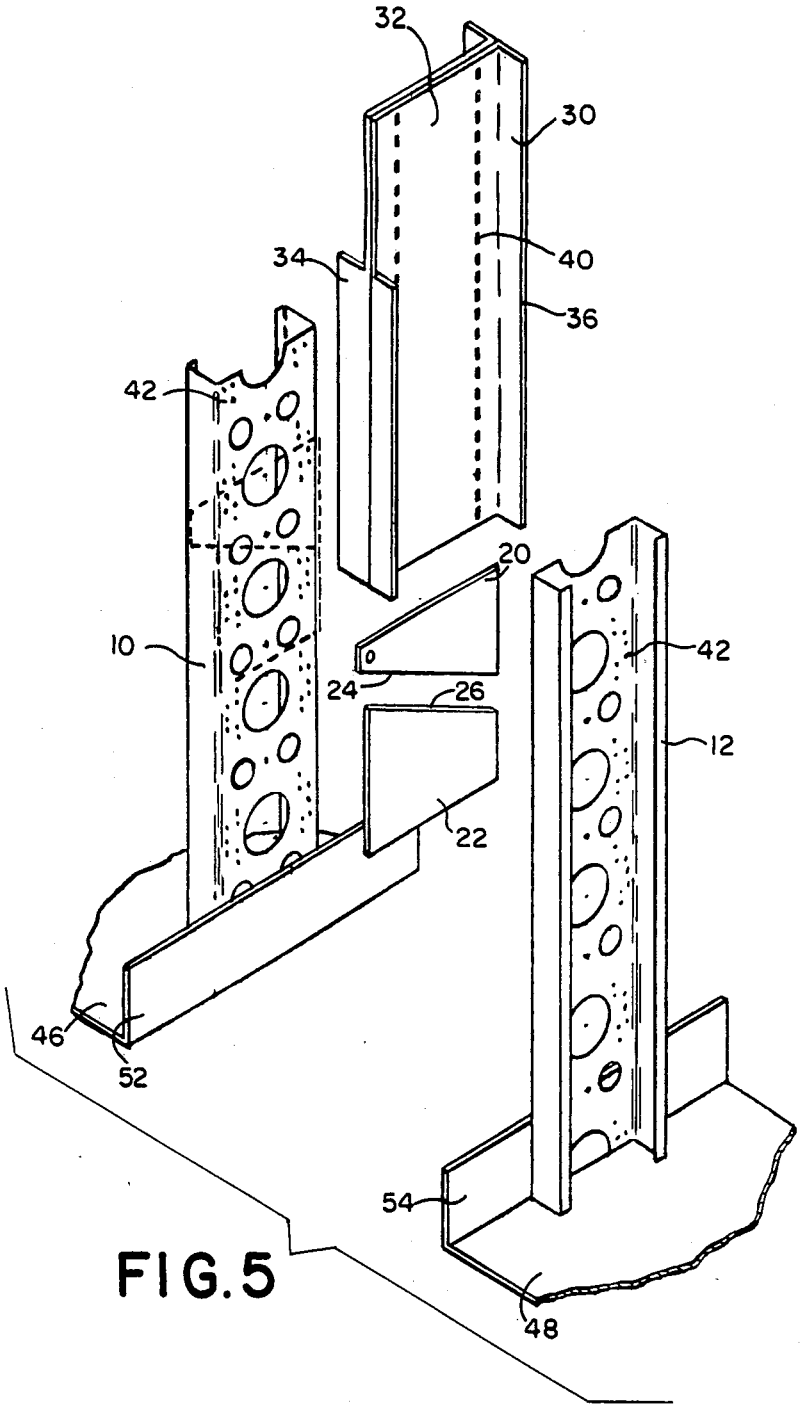
FIG. 5 is an exploded perspective view.
Figure 6:
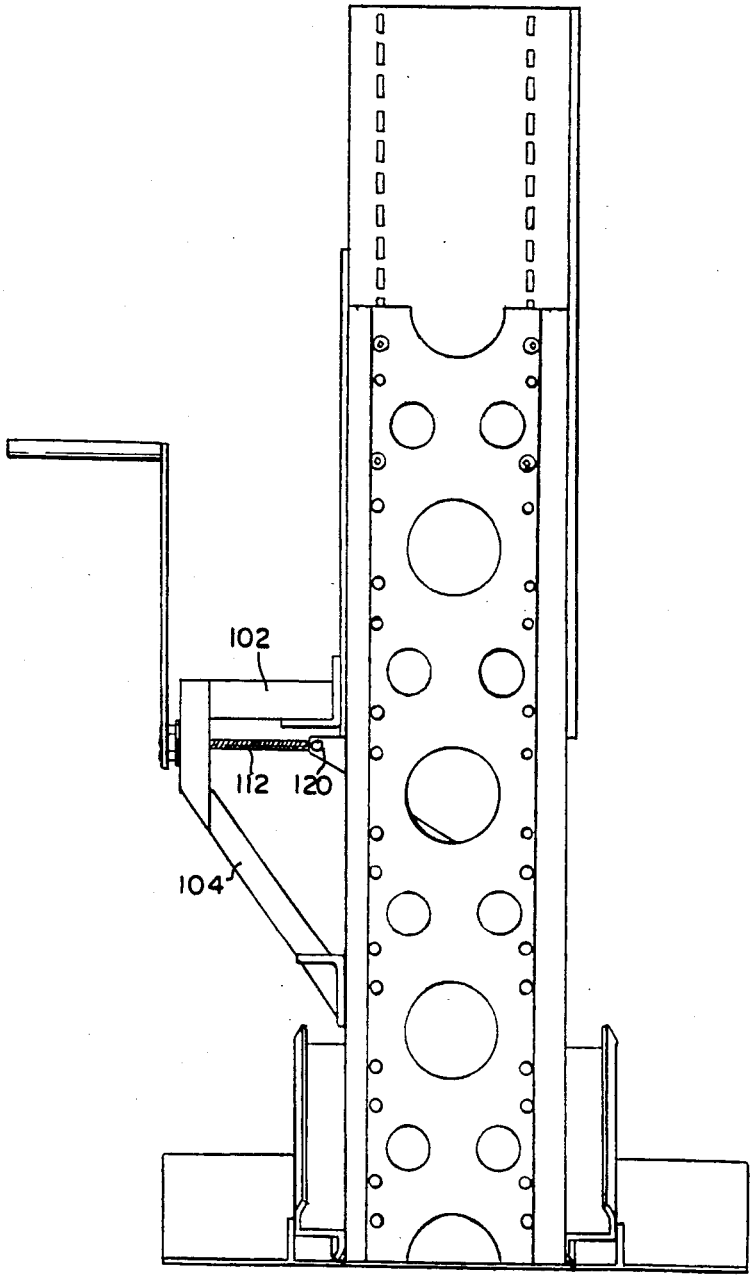
FIG. 6 is a side elevation of an alternative embodiment of a leveling device according to the present invention.
Figure 7:
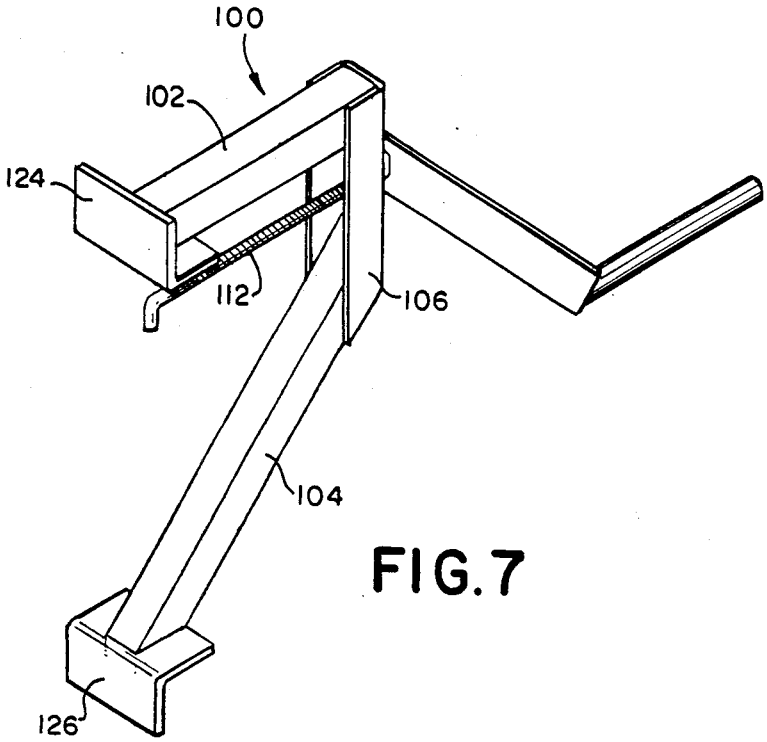
FIG. 7 is a perspective view of a pulling mechanism.
Figure 8:
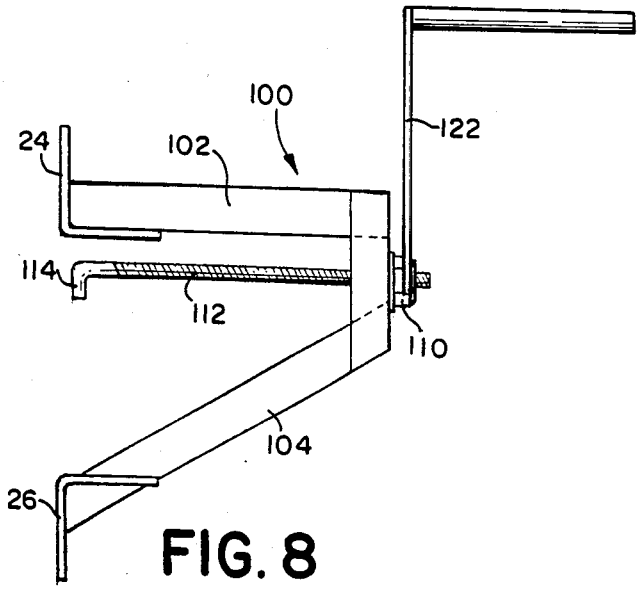
FIG. 8 is a side elevation of a pulling mechanism.
Figure 9:
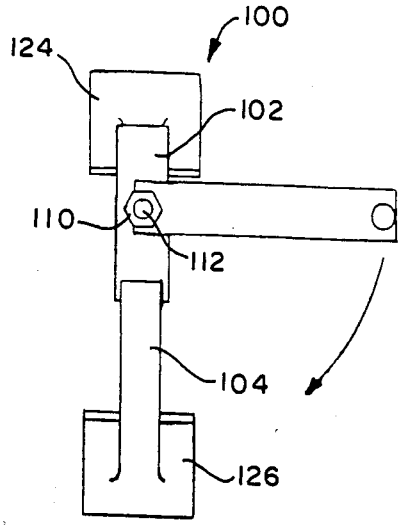
FIG. 9 is a front elevation of a pulling mechanism.
Figure 10:
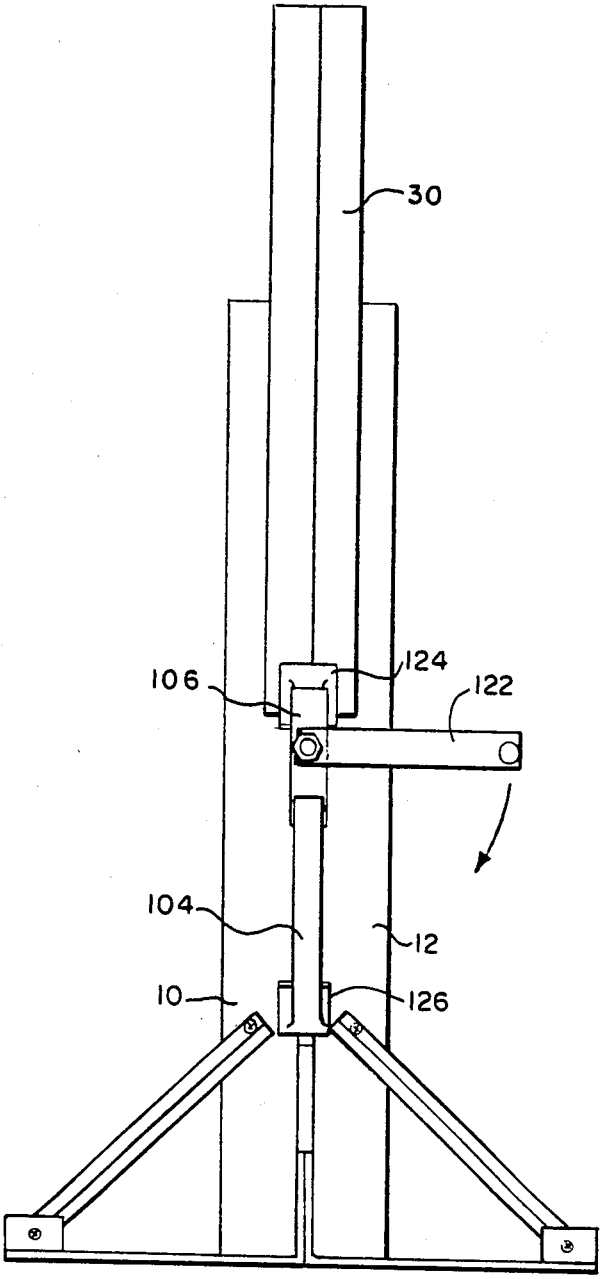
FIG. 10 is another side elevation of the alternative embodiment of FIG. 6.
Figure 11:
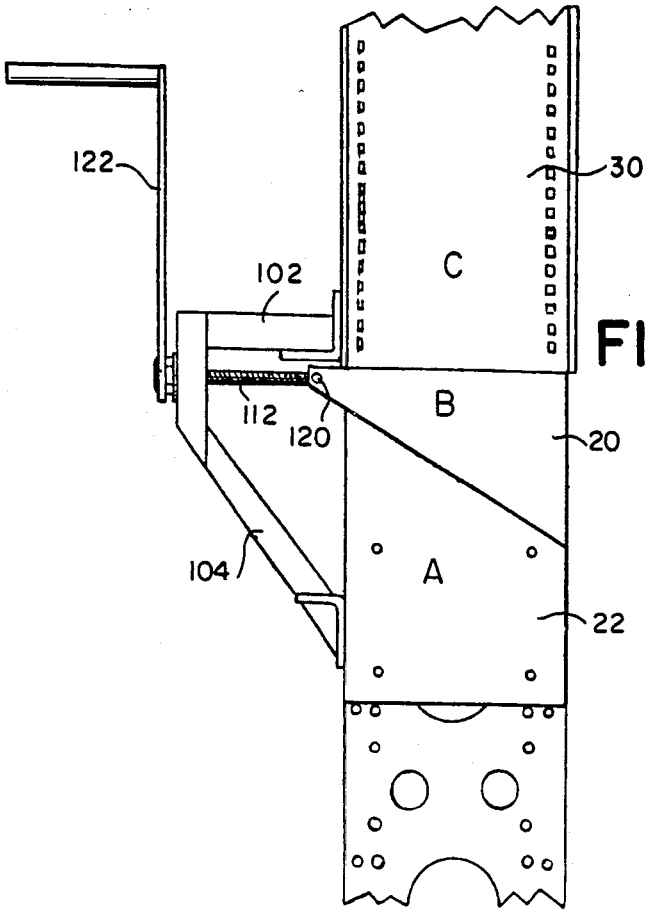
FIG. 11 is a broken away side view of the alternative embodiment of FIG. 6.
Figure 12:
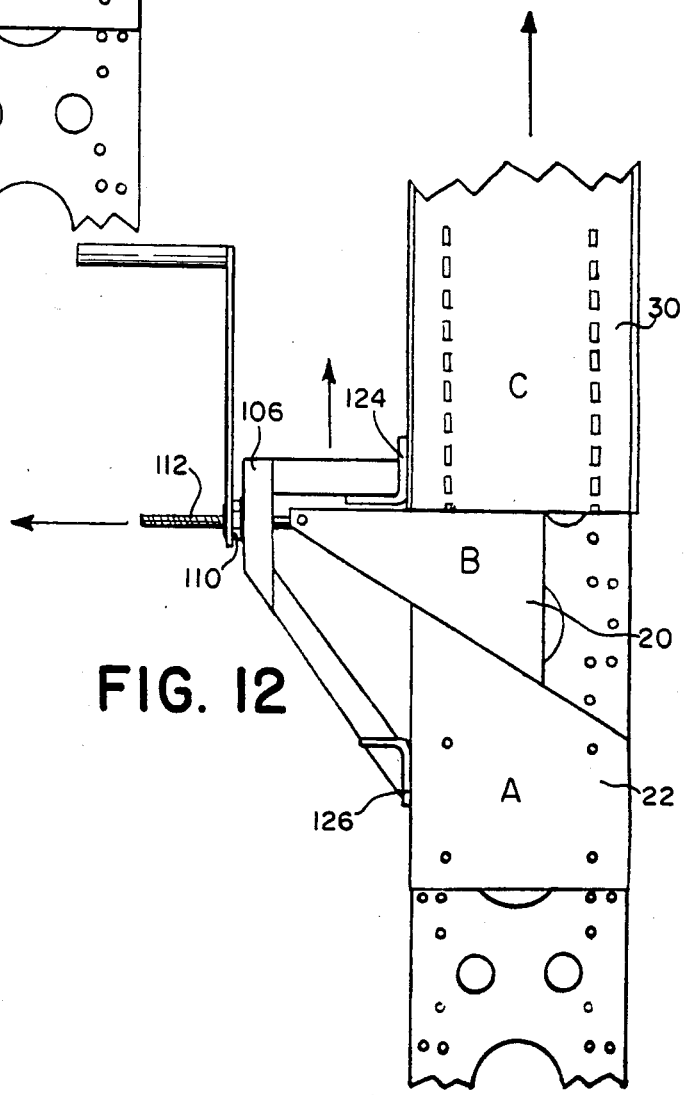
FIG. 12 is a broken away side view of the alternative embodiment of FIG. 6 showing operation of the leveling device.

The wedge members preferably include a wedge 20 and wedge stop 22 (FIG. 5 and phantom lines in FIG. 1). The wedge 20 and wedge stop 22 are substantially triangular in shape and have inclined coacting surfaces 24, 26 respectively. The wedge 20 should preferably be of greater width than the support members 10, 12 to allow easy adjustment of its lateral position to effectuate the leveling process. The wedge members are preferably made of a durable material such as steel. Preferred thicknesses are one-eighth inch, three-sixteenths inch, and one quarter inch, with the most preferred width being one-eighth inch.

The structural member 30 is a channel member of substantially I-shaped cross section with a web 32 with holes 40 and two side flanges 34, 36. The structural member is fashioned to be placed between the support members 10, 12 in the slot 14 above the wedge 20 and wedge stop 22. The side flanges 34, 36 prevent the structural member from moving laterally out of the slot 14. The side flange 34 is partially cut-away at its top so as to receive a floor support or the like. Slots or holes 40 are preferably formed in the structural member as a pair of vertical columns.

The structural member 30 is preferably made of galvanized steel, although other suitable materials known in the art such as painted steels could also be used. The steels are preferably from 10 to 20 gauge, and most preferably are 16 gauge.

The support members 10, 12, are preferably formed by C-channels such as those described in my copending U.S. patent application Ser. No. 496,960, the teachings of which are incorporated herein by reference. Each channel is preferably approximately two inches by six inches and formed from galvanized or painted steel. The channels are preferably made from 10 to 20 gauge steel, and most preferably are made from 16 gauge steel. Each channel has a series of holes 42 which align with the holes 40 in the structural member such that a rivet or screw can pass through the connector member, and both support members. A passage for a rivet or screw through both support members and through the structural member can be found at virtually any vertical position of the structural member 30 in the slot 14 because a horizontal pair in the columns of holes 40 in the structural member will almost always align somewhere with a horizontal pair of holes in the columns 42 in the support members to produce a pair of passages.

The support members 10, 12 are preferably held in parallel spaced relation by a base formed by two footing pads 46, 48. The footing pads have upturned flange portions 52, 54 which are joined together preferably by welds or screws. The support members are joined in upright fashion to the footing pads 46, 48 at the flanges 52, 54 by suitable means such as screws or rivets to firmly fasten the support members to the base. The flanges 52, 54 space the support members 10, 12 from one another when they are affixed to the base to create the slot 14. The footing pads are preferably formed from galvanized or painted steel. The steeel is preferably 10 to 20 gauge, and most preferably is 16 gauge.

Additional strength for the structure can be obtained by bracing the footing pads to the support members. Braces 58-61 preferably extend from and are affixed to upturned flanges 62-65, respectively, to the sides of the support members where they are secured by screws or rivets. The braces 58-61 are preferably formed by Z-channels made from galvanized or painted steel, and most preferably are formed from galvanized steel. The steel is preferably 10 to 20 gauge, with 16 gauge steel most preferred.

Figure 13:
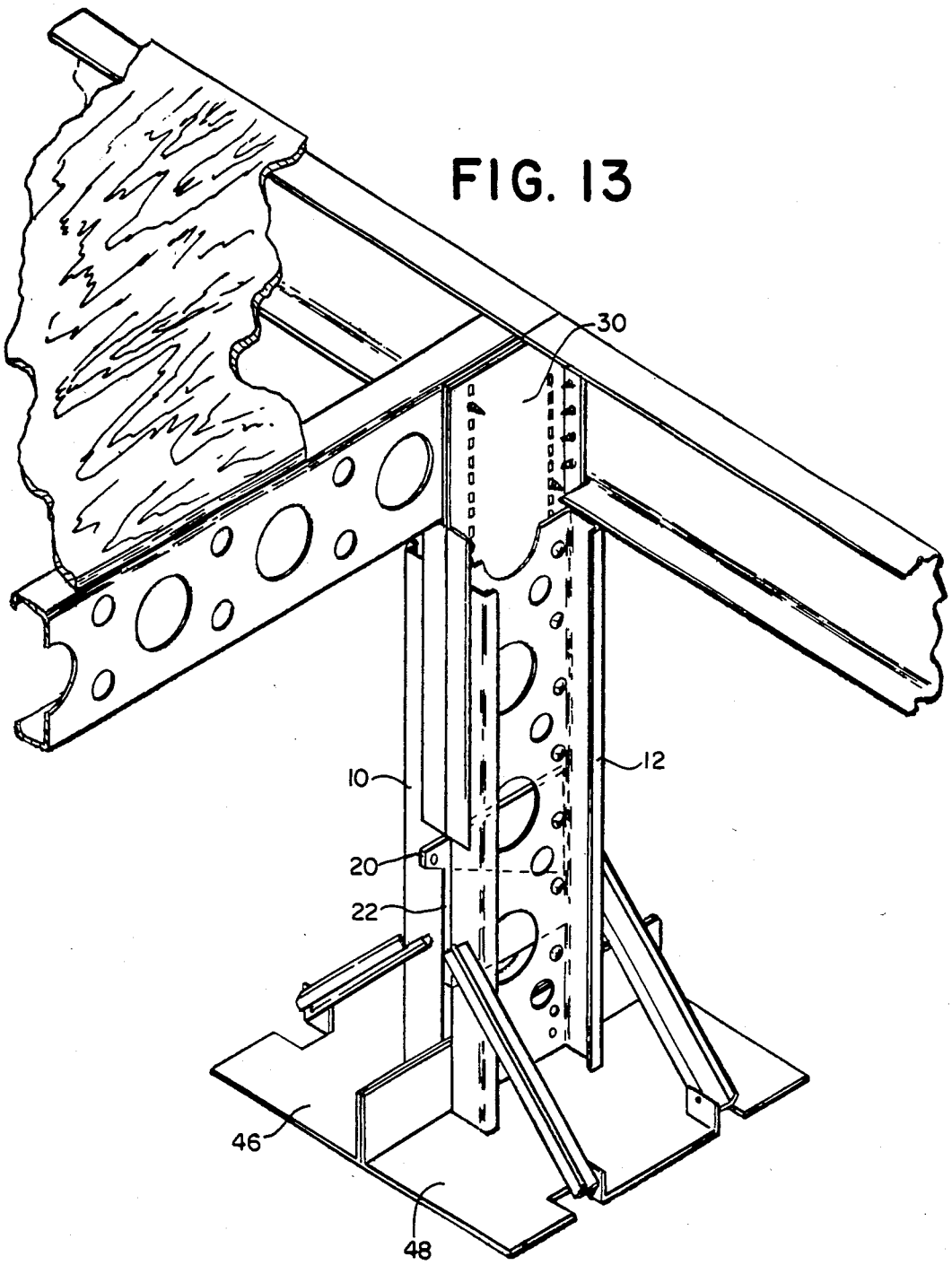
FIG. 13 is a perspective view of the leveling device as connected, partially broken away.

Operation of the leveling device begins with the device attached as a footer to floor supports (FIG. 13). The floor supports are attached to the structural member 30, preferably by rivets or screws. The wedge stop 22 is fixed in the slot 14 by means such as rivets or screws. The wedge 20 rests unattached on the wedge stop 22. The structural member 30 rests unattached in the slot 14 on the wedge 20. The wedge 20 is driven by suitable means, such as a hammer, between the wedge stop 22 and the structural member 30. The top surface 26 of the wedge stop 22 coacts with the bottom surface 24 of the wedge 20 to raise the wedge 20 and the structural member 30 as the wedge 20 is moved laterally in the direction of its short edge. When the floor has reached its proper level, the structural member 30 is fixed to the support members 10, 12 by suitable connectors such as rivets or screws. The connectors can be placed wherever holes 40 in the structural member 30 have aligned with holes 42 in the support members 10, 12 to produce passages.

Should leveling be found to require raising the structural member 30 more than the height of the wedge 20, further adjustment is easily accomplished. Screws or similar means are used to secure the structural member 30 in place. The wedge 20 can then be removed and the wedge stop 22 moved upward and fixed to a position just beneath the structural member 30. The wedge 20 is then again driven between the wedge stop 22 and the structural member 30 as before to raise the structural member 30 to the desired height.

In an alternative embodiment of the invention, structure is provided to move the wedge against the wedge stop and connector member. As shown in FIGS. 6-12, wherein like numbers refer to like elements, this structure is a pulling mechanism generally designated 100. The pulling mechanism 100 has frame structure which preferably includes a short leg 102 and a long leg 104 attached to a cross member 106. The legs 102, 104 are fixed to the ends of the cross member 106. There is a hole in the cross member 106 between the legs 102, 104. A hollow core member such as threaded nut 110 is rotatably attached to the cross member 106 such that its core aligns with the hole in the cross member 106. The nut 110 receives a threaded shaft 112 in its threaded core, such that when the nut 110 is rotated the shaft 112 is drawn through the cross member 106 and the nut 110. The shaft 112 includes structure to engage the wedge 20. Preferably this would include a hook portion 114 which would engage a hole 120 in the wedge 20. A crank 122 may be fixed to the nut 110 to assist rotation of the nut 110 and thus movement of the wedge 20. The legs 102, 104 are provided with base pads 124, 126 respectively, to provide a smooth and level base.

The hook portion 114 of the shaft 112 is engaged to the hole 120 of the wedge 20 to begin the leveling process. Base pad 124 rests on the structural member 30, and base pad 126 rests on the support members 10, 12. The handle 122 is rotated to drive the shaft 112 through the cross member 106 as the bases 124, 126 are pressed against the structural member 30 and support members 10, 12, respectively. The wedge 20 is moved by the shaft 112 through the leveling device to thereby raise the connector member 30. The pulling mechanism will raise the structural member 30 and wedge 20 as the leveling process is performed. The shaft 112 can then be detached from the hole 120 in the wedge 20 and the pulling machanism 100 removed and reused. The pulling mechanism 100, being reusable, is preferably made from a good quality high strength steel.

This invention may be embodied in other specific forms without departing from the spirit or essential attributes thereof, and accordingly, reference should be made to the appended claims, rather to the foregoing specifications, as indicating the scope of the invention.

I claim:

1. An adjustable footing system, comprising:

base means;

support means affixed to and projecting upwardly from the base means, the support means defining an open-sided, open-topped slot therebetween;

wedge means positionable in the slot substantially throughout the length of the support means and adapted for attachment to the support means in a plurality of vertical positions, the wedge means forming an abutment surface for supporting a structural member disposed in the slot; and, means for detachably connecting the wedge means and the structural member to the support means, whereby independent and alternate attachment and repositioning of the wedge means and the structural member each to the support means effects vertical adjustment of the structural member.

2. The adjustable footing system of claim 1, wherein the support means comprises two support members, each having a web portion spaced from the other, the slot being formed therebetween.

3. The adjustable footing system of claim 2, wherein the support means comprises two support members of a substantially square C-shaped cross section defining a flanged web, the support members being affixed to the base member with their webs facing but spaced from one another and their flanges directed away from one another.

4. The adjustable footing system of claim 1, wherein the wedge means comprises two wedge members.

5. The adjustable footing system of claim 1, wherein the detachable connecting means comprises:

patterns of apertures formed through the support means, the structural member and the wedge means; and, a plurality of connectors adapted for attachment in aligned apertures.

6. The adjustable footing system of claim 1, further comprising means for pulling the wedge means through the slot for effecting the vertical movement of the structural member.

7. The adjustable footing system of claim 6, wherein the pulling means comprises a frame adapted to rest against the support means.

8. The adjustable footing system of claim 7, wherein the pulling means further comprises:

means for engaging the wedge means;

means for moving the wedge means; and, means for driving the moving means.

9. The adjustable footing system of claim 8, wherein said means for moving the wedge means through the frame and said means for driving the moving means are cooperatively threaded.

10. The adjustable footing system of claim 9, wherein said means for moving the wedge means through the frame comprises a shaft and said means for driving the moving means comprises a handle rotatable relative to said shaft, whereby rotation of said handle causes said shaft to translate relative to said handle to effect pulling of said wedge.

11. The adjustable footing system of claim 10, wherein said means for engaging the wedge means comprises a hooked portion on said shaft adapted to engage an aperture in said wedge means.

12. The adjustable footing system of claim 4, further comprising means for pulling the wedge members through the slot for effecting the vertical movement of the structural member.

* * * * *